US009359703B2

(12) United States Patent
Takagi et al.

(10) Patent No.: US 9,359,703 B2
(45) Date of Patent: Jun. 7, 2016

(54) SEWING MACHINE

(71) Applicant: JANOME SEWING MACHINE Co., Ltd., Tokyo (JP)

(72) Inventors: Tustomu Takagi, Tokyo (JP); Koji Maeda, Tokyo (JP); Takuya Sawada, Tokyo (JP)

(73) Assignee: JANOME SEWING MACHINE CO., LTD., Tokyo (JP)

( * ) Notice: Subject to any disclaimer, the term of this patent is extended or adjusted under 35 U.S.C. 154(b) by 214 days.

(21) Appl. No.: 14/161,571

(22) Filed: Jan. 22, 2014

(65) Prior Publication Data

US 2014/0209002 A1 Jul. 31, 2014

(30) Foreign Application Priority Data

Jan. 31, 2013 (JP) ..... 2013-17873

(51) Int. Cl.

| | |
|---|---|
| ***D05B 63/00*** | (2006.01) |
| ***D05B 65/02*** | (2006.01) |
| ***D05B 73/12*** | (2006.01) |
| ***D05B 65/00*** | (2006.01) |
| ***D05B 65/06*** | (2006.01) |

(52) U.S. Cl.

CPC ..... *D05B 65/02* (2013.01); *D05B 63/00* (2013.01); *D05B 65/003* (2013.01); *D05B 65/06* (2013.01); *D05B 73/12* (2013.01)

(58) Field of Classification Search

CPC ..... D05B 63/00; D05B 65/06; D05B 65/00; D05B 63/04

See application file for complete search history.

(56) References Cited

U.S. PATENT DOCUMENTS

| | | | | | |
|---|---|---|---|---|---|
| 1,999,145 | A * | 4/1935 | Vollman | D04B 15/54 | 112/112 |
| 2,261,680 | A * | 11/1941 | Hale | D05B 65/003 | 112/298 |
| 3,158,117 | A * | 11/1964 | Samuels | D05B 65/003 | 112/292 |
| 3,181,490 | A * | 5/1965 | Kawasaki | D05B 65/003 | 112/185 |
| 4,465,006 | A * | 8/1984 | Dreier | D05B 65/003 | 112/292 |
| 4,748,925 | A * | 6/1988 | Takei | D05B 73/12 | 112/184 |
| 7,021,226 | B2 * | 4/2006 | Tseng | D05B 65/003 | 112/260 |

(Continued)

FOREIGN PATENT DOCUMENTS

| | | | | |
|---|---|---|---|---|
| EP | 1705279 | A2 * | 9/2006 | D05B 73/12 |
| GB | 191407640 | A * | 0/1914 | D05B 65/00 |

(Continued)

OTHER PUBLICATIONS

European Search Report for corresponding European Application EP2762628 dated May 8, 2014.*

*Primary Examiner* — Danny Worrell

(74) *Attorney, Agent, or Firm* — McGinn IP Law Group PLLC

(57) ABSTRACT

The sewing machine has: a base plate that has a guide slit for guiding a bobbin thread that is set on the bottom face side of the throat plate 1; and a bobbin thread guide member that has a guide groove for guiding the bobbin thread supplied from a bobbin and includes a cutting blade provide at the end position of the guide groove to cut the bobbin thread guided along the guide groove to an appropriate length. The bobbin thread guide member is secured to the base plate and has a holding member, which holds the end of the bobbin thread, in the guide groove, so as to maintain the state when the bobbin thread was cut.

11 Claims, 8 Drawing Sheets

(56) References Cited

U.S. PATENT DOCUMENTS

| | | | | |
|---|---|---|---|---|
| 7,194,969 | B2 * | 3/2007 | Niizeki | D05B 73/12 112/260 |
| 8,082,865 | B2 * | 12/2011 | Tseng | D05B 65/003 112/302 |
| 8,215,250 | B2 * | 7/2012 | Fukao | D05B 73/12 112/260 |
| 8,485,114 | B2 * | 7/2013 | Fukao | D05B 73/12 112/260 |
| 2014/0209002 | A1 * | 7/2014 | Takagi | D05B 63/00 112/298 |

FOREIGN PATENT DOCUMENTS

| | | | | |
|---|---|---|---|---|
| GB | 542935 | A * | 2/1942 | D05B 3/14 |
| JP | 04-096790 | | 3/1992 | |
| JP | 04-096791 | | 3/1992 | |
| JP | 2002-336579 | | 11/2002 | |

* cited by examiner

ENLARGED VIEW OF (I)

ENLARGED VIEW OF (II)

VIEW FROM ARROW DIRECTION X1 – X1

Fig.4B VIEW FROM AROW DIRECTION Y1 - Y1

Fig.4C VIEW FROM AROW DIRECTION X2 -X2

Fig.7D ENLARGED VIEW OF (III)

Fig.7F ENLARGED VIEW OF (IV)

RELATED ART
Fig.8A
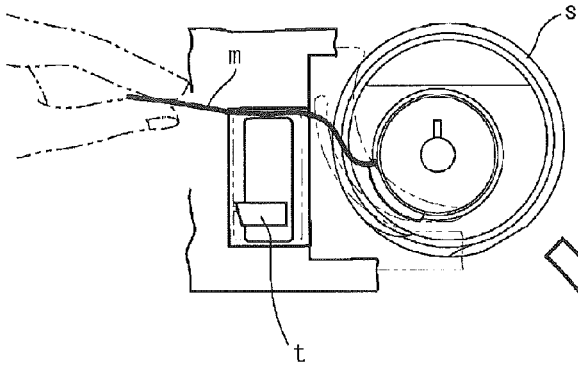
Fig.8B
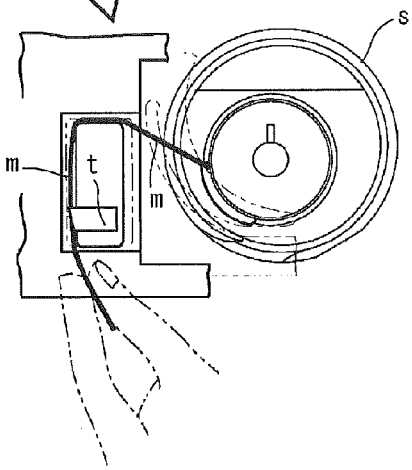
DOES NOT MAINTAIN TENSION OF BOBBIN THREAD AFTER BOBBIN THREAD IS CUT
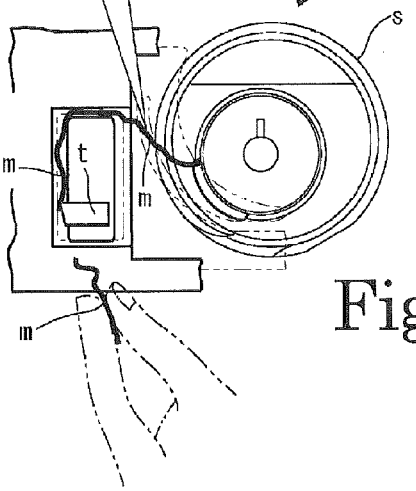
Fig.8C

SEWING MACHINE

BACKGROUND OF THE INVENTION

1. Field of the Invention

The present invention relates to a sewing machine which has a bobbin thread cutting blade in a throat plate, installs a bobbin thread bobbin in a sewing machine bed during a sewing preparation stage and draws out the bobbin thread onto the throat plate and cuts the thread to an appropriate length, and maintains the bobbin thread in a tense state generated when the bobbin thread is cut, so that the bobbin thread and the needle thread are appropriately interlocked with certainty.

2. Description of the Related Art

In the sewing operation using a household sewing machine, a needle thread and a bobbin thread are set in a sewing preparation step. The setting process is performed as follows. First a bobbin is installed in an inner rotary hook of a horizontal rotary hook. Then the bobbin thread is drawn out onto a throat plate while hooking the bobbin to a tension applying device of the inner rotary hook.

At this time the bobbin thread is drawn out with some slack from a tension generation portion onto the throat plate. The thread drawn out of the throat plate is cut to an appropriate length. When the sewing machine starts, the horizontal rotary hook operates, thereby the bobbin thread is caught and the bobbin thread and the needle thread appropriately interlock. Setting then completes.

The portion of the bobbin thread drawn out of the throat plate is cut to an appropriate length by a cutting blade of a cutting device attached to a part of the throat plate. There are various sewing machines having such a cutting device included in the throat plate, and these are disclosed in Japanese Patent Application Laid-open No. H4-96790, Japanese Patent Application Laid-open No. H4-96791 and Japanese Patent Application Laid-open No. 2002-336579.

Japanese Patent Application Laid-open No. H4-96790, Japanese Patent Application Laid-open No. H4-96791 and Japanese Patent Application Laid-open No. 2002-336579 disclose a sewing machine provided with a cover member disposed on a concave portion formed on a top face of a bed portion of the sewing machine, a holding space that is formed between the bottom face of the cover member and the concave portion, a cutting blade disposed in the bed portion, and a guide groove that is connected with the holding space in the bed portion and extends continuously on the top face of the bed portion from a housing opening to the cutting blade, so as to guide a bobbin thread drawn out of the housing opening to the cutting blade, wherein the holding space holds the bobbin thread which passed through the guide groove so that the bobbin thread does not upward.

This configuration allows the bobbin thread which is drawn out onto the throat plate to be cut to an appropriate length very easily, and the bobbin thread can be efficiently set by a device constituted by the horizontal rotary hook (the outer rotary hook and the inner rotary hook) and the bobbin.

SUMMARY OF THE INVENTION

As mentioned above, Japanese Patent Application Laid-open No. H4-96790, Japanese Patent Application Laid-open No. H4-96791 and Japanese Patent Application Laid-open No. 2002-336579 disclose making the operation to cut the bobbin thread to an appropriate length when setting of the bobbin thread simpler and quicker. However in the prior arts in Japanese Patent Application Laid-open No. H4-96790, Japanese Patent Application Laid-open No. H4-96791 and Japanese Patent Application Laid-open No. 2002-336579, the following problems exist. FIG. 8 shows cutting steps of the bobbin thread m according to a prior art. In this operation of cutting the bobbin thread m to an appropriate length, the bobbin thread becomes tense when the bobbin thread m is cut by a cutting blade t of the cutting device.

In other words, the bobbin thread m becomes tense, even if slightly, when the bobbin thread is strongly pressed against the cutting blade t. When the bobbin thread m is cut to an appropriate length, the bobbin thread m is released from the tense state, and due to this reaction the bobbin thread m is retracted to the horizontal rotary hook s side.

The retracted bobbin thread m loosens (slackens) below the throat plate. Therefore when the sewing machine is started, an appropriate interlocking of the bobbin thread m and the needle thread (not shown in figures) is not generated in the beginning of sewing, and an inappropriate entanglement of threads, such as a skipped stitch and trapping in the rotary hook, may occur in the beginning of sewing.

There are many types of bobbin threads: thin, thick, soft, hard and the like. The form of the thread line of such a bobbin thread does not easily become straight, and once it loosens (slackens) the loose state is maintained and a skipped stitch in the beginning and an inappropriate entangle of threads, such as trapping in the rotary hook, may occur, as mentioned above.

If the bobbin thread cannot be set appropriately, operations subsequent to the setting are affected, whereby the entire operation time may increase or other operations of the sewing machine may not be performed smoothly. With the foregoing in view, the technical problem that the present invention is to solve (the object) is to continuously maintain the tense state after the bobbin thread is cut, and allow the bobbin thread and the needle thread to interlock appropriately in the beginning of sewing without fail, even if an unnecessary portion of the bobbin thread in a tense state is cut by the cutting blade during setting of the bobbin thread.

As a result of spirited research, the present inventor solved the problem by a first aspect of the present invention, that is, a sewing machine provided with a needle bar to which a needle is attached, a horizontal rotary hook that houses a bobbin on which a bobbin thread for forming stitches in tandem with the vertical operation of the needle bar is wound, a throat plate that houses the horizontal rotary hook in a bed and covers an opening of a top face of the bed, and an opening lid that covers the opening of the throat plate, this sewing machine including: a base plate that has a guide slit for guiding the bobbin thread that is set on the bottom face side of the throat plate; and a bobbin thread guide member that has a guide groove for guiding the bobbin thread supplied from the bobbin and includes a cutting blade provided at the end position of the guide groove to cut the bobbin thread guided along the guide groove to an appropriate length, wherein the bobbin thread guide member is secured to the base plate and has a holding member, which holds the end of the bobbin thread, in the guide groove, so as to maintain the state when the bobbin thread was cut.

The above problem is solved by a second aspect of the present invention, that is, the sewing machine according to the first aspect, wherein the holding member is disposed so as to plug the guide groove. The above problem is solved by a third aspect of the present invention, that is, the sewing machine according to the first or the second aspect, wherein the holding member is an elastic member.

The above problem is solved by a fourth aspect of the present invention, that is, the sewing machine according to any one of the first, second and third aspects, wherein the holding member is made of a felt material. The above problem is solved by a fifth aspect of the present invention, that is, the sewing machine according to any one of the first, second and third aspects, wherein the holding member is made of a sponge material.

The above problem is solved by a sixth aspect of the present invention, that is, the sewing machine according to any one of the first, second and third aspects, wherein the holding member is made of a rubber material. The above problem is solved by a seventh aspect of the present invention, that is the sewing machine according to any one of the first, second and third aspects, wherein the holding member is a brush type member. The above problem is solved by an eighth aspect of the present invention, that is, the sewing machine according to any one of the first, second and third aspects, wherein the holding member is a spring.

The present invention is constituted by: a base plate that has a guide slit for guiding the bobbin thread from a bobbin that is set on the bottom face side of the throat plate; and a bobbin thread guide member that has a guide groove for guiding the bobbin thread supplied from the bobbin, and includes a cutting blade at the end position of the guide groove for cutting the bobbin thread, that is guided along the guide groove, to an appropriate length. The bobbin thread guide member is secured to the base plate and has a holding member, which holds the end of the bobbin thread, in the guide groove, so as to maintain the state when the bobbin thread was cut.

In other words, the holding member is located between the start position and the end position of the guide groove, and is located closer to the start position than the position of the cutting blade. Therefore the bobbin thread which is drawn out allowing some slack is pressed against the cutting blade which is attached to the bobbin thread guide member when the bobbin thread is cut to an appropriate length. As a consequence, the bobbin thread becomes tense and is secured appropriately in this position by the holding member.

Therefore even immediately after the bobbin thread is cut by the cutting blade at the end position of the guide groove, the bobbin thread is maintained in the tense state between the bobbin thread guide member and the horizontal rotary hook. In other words, the bobbin thread can form a linear thread locus between the bobbin thread guide member and the horizontal rotary hook without slack (loosening), and the bobbin thread and the needle thread can be appropriately interlocked without fail.

Particularly in the present invention, even if the bobbin thread is thin, thick, soft or hard (firm), the bobbin thread is secured by the holding member (felt, sponge, rubber, brush, spring or the like), therefore the tense state after being cut by the cutting blade can be sufficiently maintained.

BRIEF DESCRIPTION OF THE DRAWINGS

FIG. 4B is an enlarged cross-sectional view of Y1-Y1 arrows of FIG. 4A including the upper half body, FIG. 4C is an enlarged cross-sectional view of X2-X2 arrows of FIG. 4A including the upper half body.

FIG. 7D is an enlarged view of (III) of FIG. 7C, FIG. 7F is an enlarged view of (IV) of FIG. 7E; and FIG. 8A to FIG. 8C are state diagrams depicting steps of cutting the bobbin thread according to a prior art.

DESCRIPTION OF THE PREFERRED EMBODIMENTS

Embodiments of the present invention will now be described with reference to the drawings. According to the present invention, when a bobbin 6, which has bobbin thread n wound around it, is set below a throat plate 1 of the sewing machine main unit 8, in particular, in a sewing operation preparation stage, a portion of the bobbin thread drawn out of the bobbin 6 is cut to an appropriate length, and the bobbin thread n after cutting is maintained in a tense state generated during cutting in a preparation stage., so that the bobbin thread n and a needle thread (not illustrated) interlock appropriately from the start of sewing without fail.

Figure 1A:
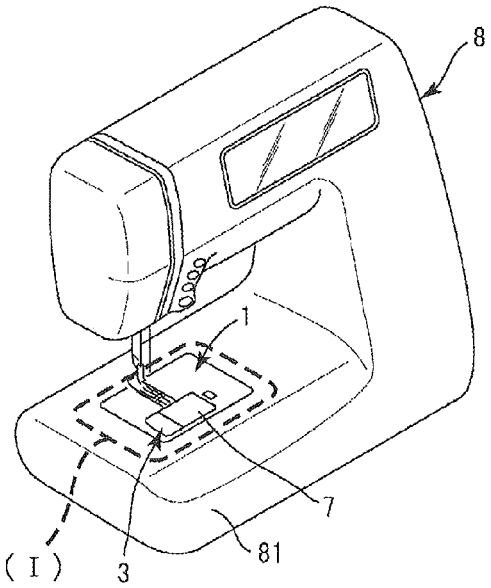
FIG. 1A is a perspective view of a sewing machine main unit of the present invention.

As illustrated in FIG. 1 and FIG. 2, major composing elements of the present invention are, for example, a throat plate 1, a base plate 2, a bobbin thread guide member 3, a holding member 4, a horizontal rotary hook 5 and a bobbin 6. The throat plate 1 is disposed in a bed portion 81 of the sewing machine main unit 8, as illustrated in FIG. 1A. The front face of the sewing machine main unit 8 is the surface where an operation portion and a display are disposed, as illustrated in FIG. 1A.

The throat plate 1 is attached to a position close to the left edge when the sewing machine main unit 8 is viewed from the front face, just like a standard sewing machine. The horizontal rotary hook 5, constituted by an outer rotary hook 51 and an inner rotary hook 52, is housed in the bed portion where the throat plate 1 is attached (see FIG. 2A and FIG. 4A).

A housing opening 11 is formed on the throat plate 1, so that the bobbin 6 can be inserted in or taken out of the inner rotary hook 52 of the horizontal rotary hook 5 through this housing opening 11. The housing opening 11 is a rectangular through hole.

Figures 2A, 2B, 2C:
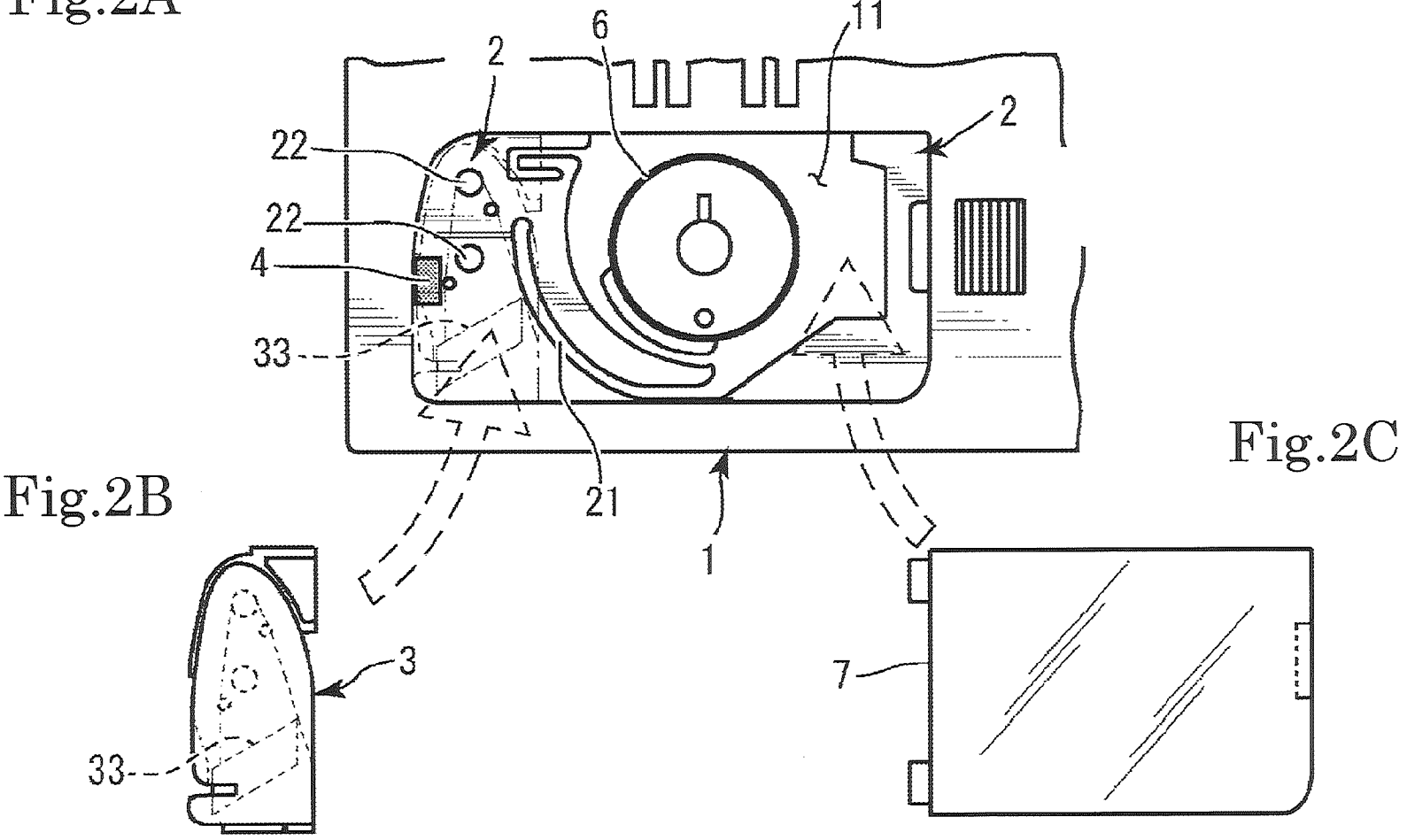
FIG. 2A is an enlarged view of a housing opening of a throat plate.
FIG. 2B is a plan view of a bobbin thread member.
FIG. 2C is a plan view of an opening lid.

The base plate 2 is disposed on a part of the edge of the housing opening 11 of the throat plate 1 (see FIG. 2A). The base plate 2 is secured on the rear face side of the throat plate 1 by such a fixture as a screw, and plays a part of a base plate where the later mentioned bobbin thread guide member 3 and an opening lid 7 are attached.

In concrete terms, the base plate 2 is disposed from a position close to the left edge, a position close to the right edge and a position close to the front edge of the housing opening 11. The left, right and front of the housing opening 11 are directions when the sewing machine main unit 8 is viewed from the front face. A guide slit 21 is formed on the base plate 2 for guiding the bobbin thread drawn from the bobbin 6 onto the throat plate 1 (see FIG. 2A and FIG. 4A).

Figure 3B:
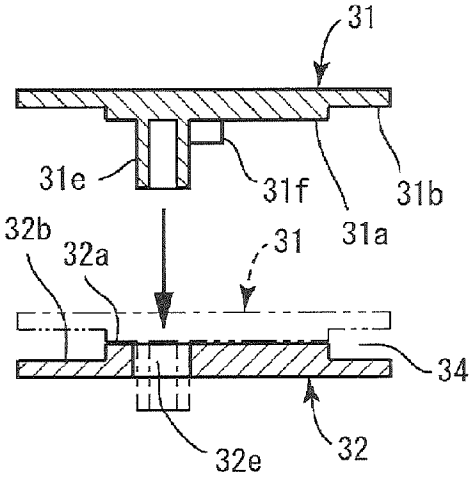
FIG. 3B is an enlarged cross-sectional view of X1-X1 arrows of FIG. 3A.
Figure 3C:
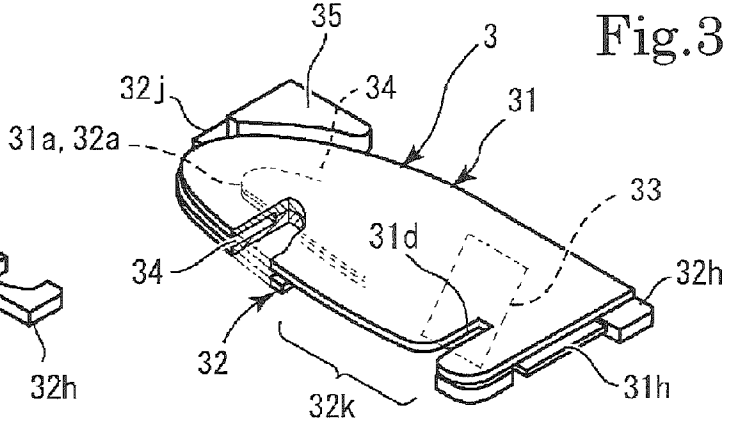
FIG. 3C is a perspective view of the partially omitted bobbin thread guide member.

As illustrated in FIG. 3, the bobbin thread guide member 3 is constituted by an upper half body 31, a lower half body 32 and a cutting blade 33. The upper half body 31, the lower half body 32 and the cutting blade 33 are vertically joined (see FIG. 3B), whereby the bobbin thread guide member 3 is constructed (see FIG. 3C, FIG. 4C and FIG. 4D, for example).

The upper half body 31 is mainly constituted by a thick guide portion 31*a* and a thin edge portion 31*b*. The thin edge portion 31*b* is formed on the upper face side of the thick guide portion 31*a*, so as to horizontally protrude from the edge. The thick guide portion 31*a* protrudes downward as a flat plane from the thin edge portion 31*b*.

Figure 3A:
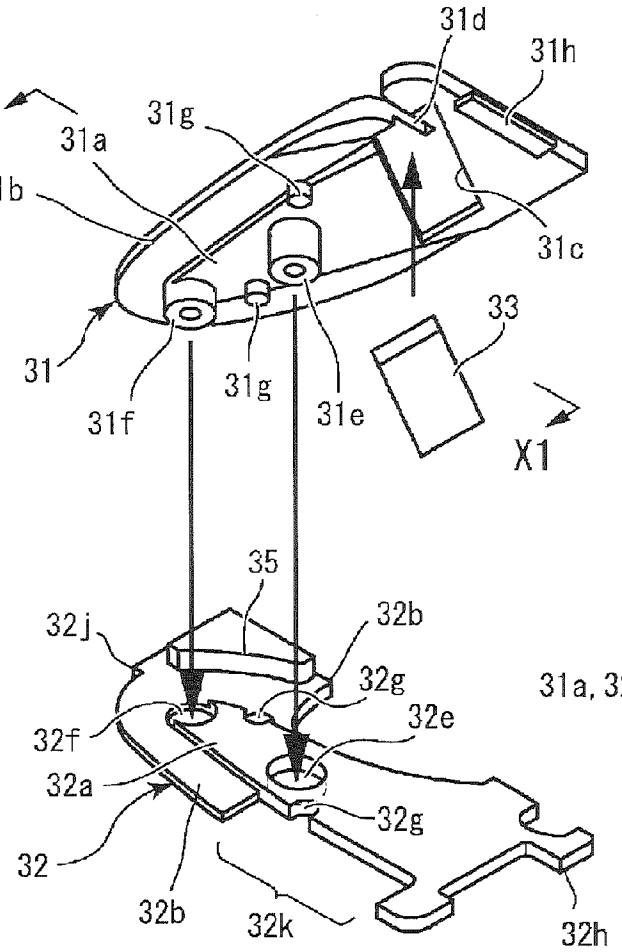
FIG. 3A is a perspective view of the bobbin thread guide member in a state where the upper half body, the lower half body and the cutting blade are separated.

The thick guide portion 31*a* is formed to be a triangular shape, which looks approximately V-shaped when viewed from the rear face, and the point angle portion, which is an apex of the triangular shape, is formed in an arc which is approximately a semi-circle (see FIG. 3A). A cutting blade attachment portion 31*c* is formed on the thick guide portion 31*a*. The cutting blade attachment portion 31*c* is an area where the cutting blade 33 is attached, and is a flat rectangular parallelepiped concave portion similar to the shape of the cutting blade 33. The cutting blade attachment portion 31*c* is formed in the end portion 34*b* of a guide groove 34, which is described later.

A cutting guide groove portion 31*d* is formed so as to reach to the end position 34*b* of the later mentioned guide groove 34, which is a part of the cutting blade attachment portion 31*c* (see FIG. 1C and FIG. 3A). The cutting blade 33 protrudes to be exposed outside the cutting guide groove portion 31*d* in a state of being attached to the cutting blade attachment portion 31*c* (see FIG. 1C and FIG. 3C).

The bobbin thread n guided from the later mentioned guide groove 34 to the cutting guide groove portion 31*d* is cut by the cutting blade 33 protrudes into the cutting guide groove portion 31*d* (see FIG. 1C and FIG. 3C).

A primary joining protrusion 31*e* and a secondary joining protrusion 31*f* are formed in the thick guide portion 31*a* of the upper half body 31 (see FIG. 3A). The primary joining protrusion 31*e* and the secondary joining protrusion 31*f* have a cylindrical shape. The primary joining protrusion 31*e* is formed approximately in the center of the thick guide portion 31*a*, and the secondary joining protrusion 31*f* is formed in the top part of the arc shape of the thick guide portion 31*a*.

The secondary joining protrusion 31*f* may be in an area constituting the top part of the arc shape of the thick guide portion 31*a* (see FIG. 3 A). An alignment protrusion 31*g* may be formed in the outer periphery of the thick guide portion 31*a*. The alignment protrusion 31*g* is formed in two locations (see FIG. 3A). A mounting latch 31*h* is formed in the upper half body 31, so as to be attached to the mounting position of the bobbin thread guide member 3 constituted by the throat plate 1 and the base plate 2.

Figure 4A:
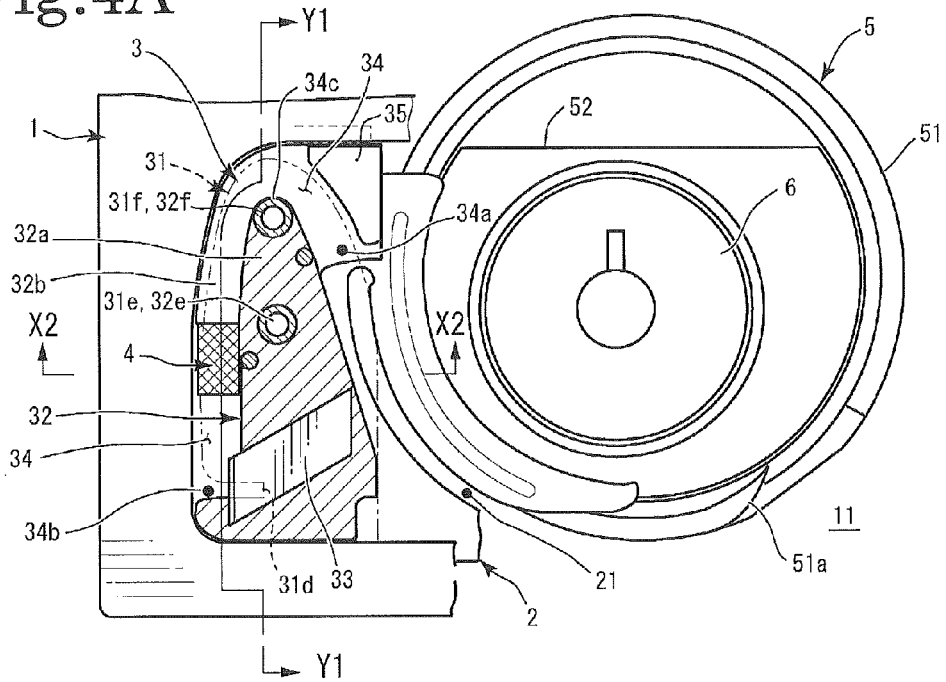
FIG. 4A is an enlarged plan view when the bobbin thread guide member (upper half body is not illustrated) is set in a housing opening.
Figure 4A:
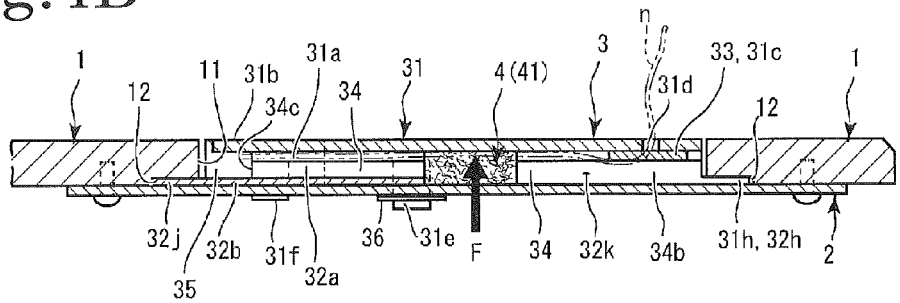
Figure 4A:
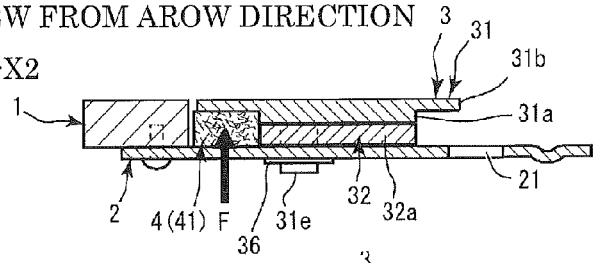

As illustrated in FIG. 3A, FIG. 4A and FIG. 4B, the lower half body 32 is mainly constituted by a thick guide portion 32*a* and a thin edge portion 32*b*. The thin edge portion 32*b* is formed on the rear side of the thick guide portion 32*a*, so as to horizontally protrudes from the edge. The thick guide portion 32*a* protrudes upward as a flat plane from the front face side of the lower half body 32 (see FIG. 3A).

The thick guide portion 32*a* is formed to be a triangular shape, which looks approximately V-shaped, similar to the thick guide portion 31*a* of the upper half body 31 (see FIG. 3A). A primary joining hole 32*e* and a secondary joining hole 32*f* are formed in the thick guide portion 32*a*. An alignment hole 32*g* is also formed in the thick guide portion 32*a*.

Mounting latches 32*h* and 32*j* are formed in the lower half body 32. The mounting latches 32*h* and 32*j*, along with the mounting latch 31*h* of the upper half body 31, can fit into fitting grooves 12 formed by the throat plate 1 and the base plate 2 (see FIG. 4B and FIG. 4D).

Then the bobbin thread guide member 3 is formed by combining the upper half body 31 and the lower half body 32. First the cutting blade 33 is secured to the cutting blade attachment portion 31*c* of the upper half body 31, and the thick guide portion 31*a* and the thick guide portion 32*a* are contacted by joining the rear face side of the upper half body 31 and the front face side of the lower half body 32.

At this time, the primary joining protrusion 31*e* is inserted into the primary joining hole 32*e*, and the secondary joining protrusion 31*f* is inserted into the secondary joining hole 32*f*. The alignment protrusion 31*g* is inserted into the alignment hole 32*g* (see FIG. 3A and FIG. 3B).

The guide groove 34 is formed on the periphery of the bobbin thread guide member 3 by the thick guide portion 31*a* and the thin edge portion 31*b* of the upper half body 31, and the thick guide portion 32*a* and the thin edge portion 32*b* of the lower half body 32 (see FIG. 10, FIG. 3C, FIG. 4A, FIG. 4B and FIG. 4D, for example).

A start position 34*a* and an end position 34*b* exist in the groove guide 34. The start position 34*a* is located on the horizontal rotary hook 5 side, and the end position 34*b* is located approximately at the attachment position of the cutting blade 33. The tip of the triangle formed by the thick guide portion 31*a* of the upper half body 31 and the thick guide portion 32*a* of the lower half body 32 is the turning back portion 34*c* of the guide groove 34.

The turning back portion 34*c* is formed in a semicircular arc shape, and plays a part of protecting the bobbin thread n when the bobbin thread n is smoothly guided to the guide groove 34, and preventing, together with the guide groove 34, the deviation of the bobbin thread from the groove. The guide groove 34 is formed in an approximate V shape or U shape.

A non-formation region 32*k*, where the thin edge portion 32*b* is not formed, exists in the thin edge portion 32*b* of the lower half body 32 (see FIG. 3A and FIG. 3C). In other words, in an area of the lower half body 32 where the thin edge portion 32*b* exists, the guide groove 34 is vertically constituted by the thin edge portions 31*b* and 32*b*.

In the non-formation region 32*k* of the lower half body 32, the guide groove 34 is constituted by only the thin edge portion 31*b* of the upper half body 31, since the thread passage faces the cutting blade 33. In the non-formation region 32*k* of the lower half body 32, a part of the base plate 2 and the thin edge portion 31*b* of the upper half body 31 constitute the guide groove 34 (see FIG. 10, FIG. 4A, FIG. 4B and FIG. 4C).

Further, in the thin edge portion 32*b* of the lower half body 32, a guide protrusion portion 35 is formed near the start position 34*a* of the guide groove 34 (see FIG. 10 and FIG. 3C). The guide protrusion portion 35 is a protrusion formed approximately in a triangular shape, which makes it easier to guide and insert the bobbin thread n into the start position 34*a* of the guide groove 34.

Figure 1B:
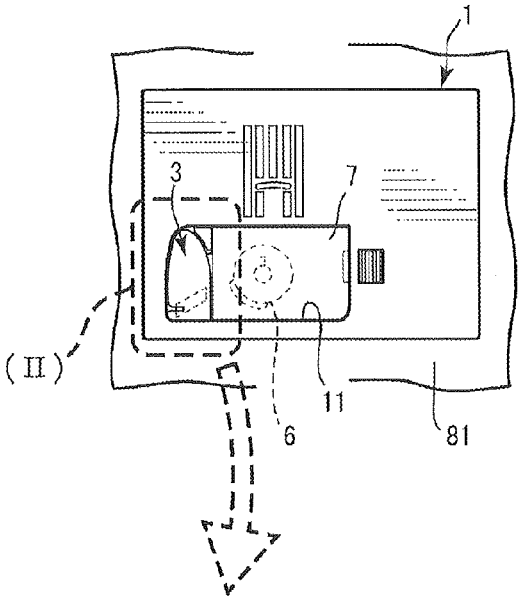
FIG. 1B is an enlarged view of (I) in FIG. 1A.
Figure 1C:
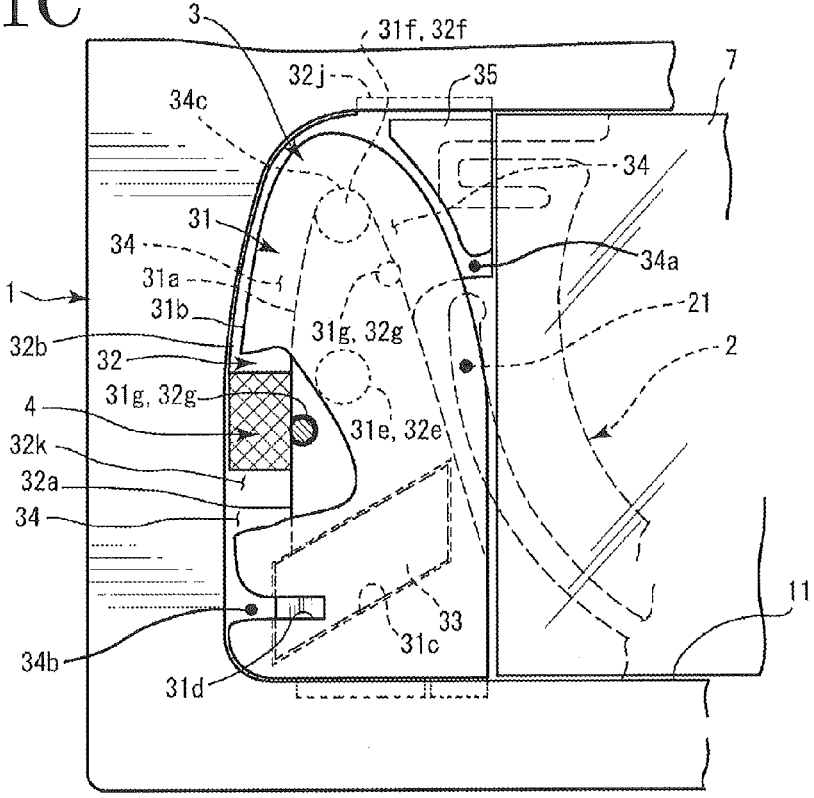
FIG. 1C is an enlarged view of (II) in FIG. 1B.

The bobbin thread guide member 3 is attached to a part of the edge of the housing opening 11 of the throat plate 1, and in concrete terms, the bobbin thread guide member 3 is secured to the base plate 2 in a position to the left of the housing opening 11 (see FIG. 1B and FIG. 10).

Two mounting holes 22 are formed in the base plate 2 (see FIG. 2A) so that the primary joining protrusion 31*e* and the secondary joining protrusion 31*f* of the bobbin thread guide member 3 are inserted, and the primary joining protrusion 31*e* and the secondary joining protrusion 31*f* that are inserted are secured by a fixture 36, such as a snap ring, from the rear face of the base plate 2.

Figure 4D:
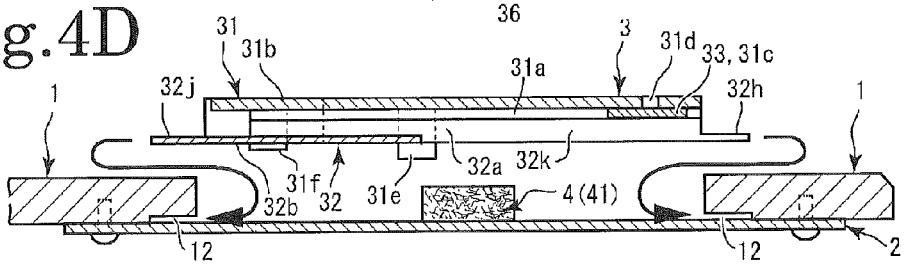
FIG. 4D is an enlarged cross-sectional view of a state when a throat plate, where the holding member is attached to the base plate, is separated from the bobbin thread guide member.

The mounting latches 31*h*, 32*h* and 32*j* formed on the upper half body 31 and the lower half body 32 of the bobbin thread guide member 3 are fitted into and secured to the fitting grooves 12 formed by the throat plate 1 and the base plate 2 (see FIG. 4B and FIG. 4D).

Figure 6A:
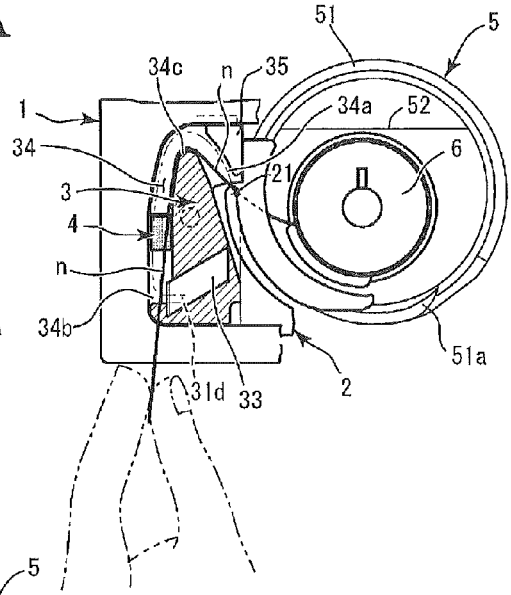
FIG. 6A to FIG. 6C are state diagrams depicting the state when the bobbin thread is cut by the cutting blade and the tense state of the bobbin thread is maintained after being cut.
Figure 6B:
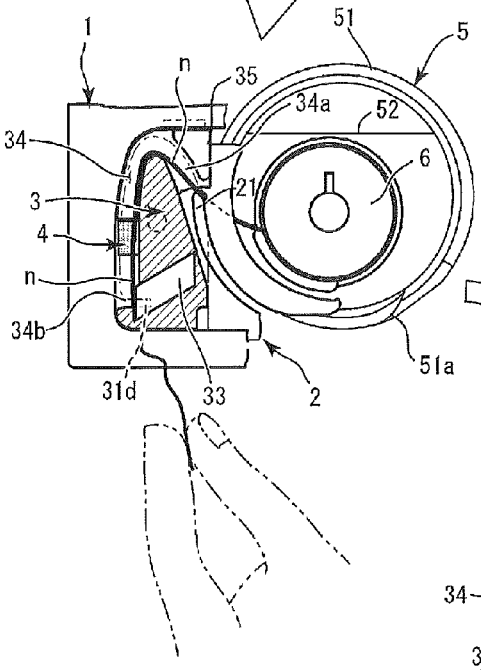
Figure 6C:
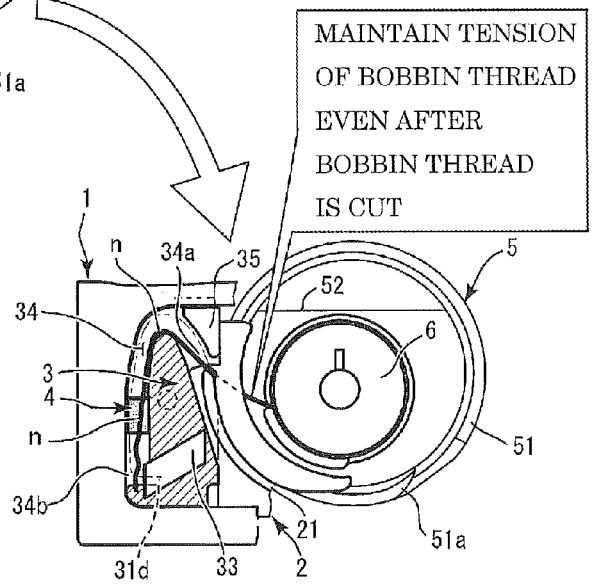

The holding member 4 holds the bobbin thread n, which was cut by the cutting blade 33, in the held state, so that the horizontal rotary hook 5 in the housing opening 11 and the bobbin thread n are maintained in the tense state during cutting, even after cutting (see FIG. 6C). The holding member 4 is disposed in the guide groove 34 of the bobbin thread guide member 3, which is secured to the base plate 2. In concrete terms, the holding member 4 is disposed so as to plug the guide groove 34 of the bobbin thread n. Thereby the bobbin thread that is inserted and passed through the guide groove can be held without fail, and the tension of the bobbin thread can be maintained even after the bobbin thread is cut.

As mentioned later, the holding member 4 may be secured to the base plate 2 side or may be secured to the bobbin thread guide member 3 side depending on the embodiment. In the case of securing the holding member 4 to the base plate 2, the holding member 4 and the bobbin thread guide member 3 (the thin edge portion 31*b* of the upper half body 31 thereof) only contact, and are not bonded by adhesive.

In the case of securing the holding member 4 to the bobbin thread guide member 3, the bottom end of the holding member 4 and the base plate 2 only contact, and are not bonded by adhesive. Therefore the bobbin thread n that passes through the guide groove 34 of the bobbin thread guide member 3 is inserted between the top end of the holding member 4, which is disposed to plug the guide groove 34, and the bobbin thread guide member 3 (the thin edge portion 31*b* of the upper half body 31 thereof) (see FIG. 4B). Instead the bobbin thread n may be inserted between the bottom end of the holding member 4 and the base plate 2.

In the case of the embodiment where the holding member 4 is secured to the base plate 2 side, the holding member 4 is in the guide groove 34 between the base plate 2 and the bobbin thread guide member 3, so as to be located in an appropriate position between the start position 34*a* and the end position 34*b* of the guide groove 34 (see FIG. 10 and FIG. 4A).

In concrete terms, the position in the guide groove 34 where the holding member 4 is installed is on the start position 34*a* side of the position where the cutting blade 33 is attached and where position of the cutting guide groove portion 31*d* is attached. The position of the holding member 4 is adjacent to the cutting guide groove portion 31*d*.

A specific position where the holding member 4 is installed based on the above configuration is a position on the base plate 2 corresponding to the non-formation region 32*k* of the lower half body 32 in a state where the bobbin thread guide member 3 is installed in a predetermined position of the base plate 2, and the holding member 4 is secured to this position (see FIG. 10, FIG. 4A and FIG. 4D).

As a result, the bobbin thread n introduced from the start position 34*a* of the guide groove 34 passes through the turning back portion 34*c*, is held and pressed by the holding member 4 and the thin edge portion 31*b* of the upper half body 31, and the end of the bobbin thread n is maintained in the tense state (see FIG. 6).

An embodiment of the holding member 4 is a block 41 constituted by an elastic member. The elastic member is made of such material as felt, sponge or rubber. The bobbin thread can be held and secured relatively firmly in the guide groove by elasticity thereof.

If a felt material is used for the holding member, the bobbin thread is secured by soft material, which is particularly preferable for a bobbin thread that is thin and has low durability. If a sponge material is used for the holding member, a sponge material, which has flexible elasticity, can hold and secure a bobbin thread in a stable state whether the thread is thin or thick. If a rubber material is used for the holding member, the holding force increases not only by elasticity, but also by a moderate roughness of the rubber surface, and the bobbin thread can be secured relatively firmly.

When these materials are used, the holding member 4 is formed to be a soft block 41 having a rectangular parallelepiped shape. The block 41 (the holding member 4) may be cylindrical. The block 41 is bonded by such a bonding means as adhesive.

It is preferable that the holding member 4 contacts the thin edge portion 31*b* of the upper half body 31 and the holding member 4 always contacts the thin edge portion 31*b* with pressing force F, so that the block 41 (the holding member 4) can secure the bobbin thread n with an optimum pressing force (see FIG. 4B and FIG. 4C). By the pressing force F, the bobbin thread n is pressed firmly and retractably, and is maintained in this state.

Figure 7A:
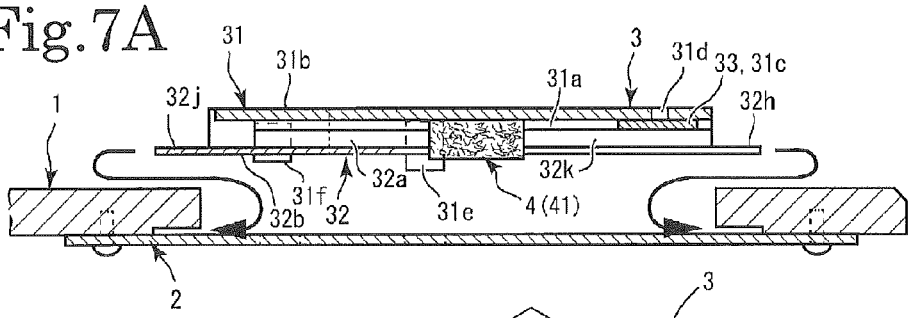
FIG. 7A is an enlarged cross-sectional view of a key portion according to an embodiment where the holding member is attached to the bobbin thread guide member.
Figure 7B:
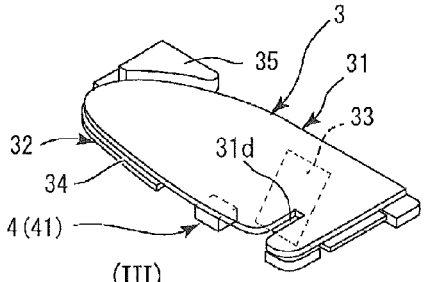
FIG. 7B is a perspective view of a state when the holding member is attached to the bobbin thread guide member.
Figure 7C:
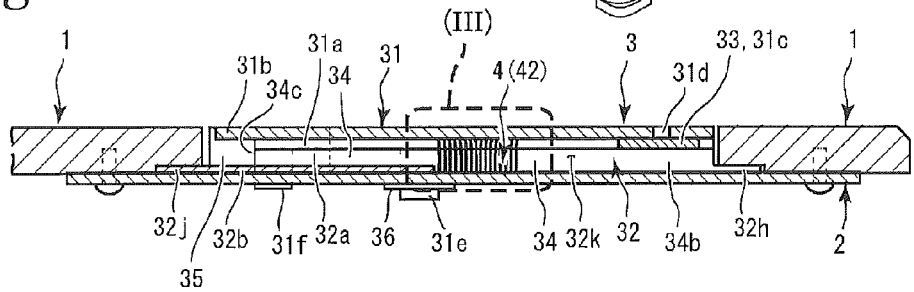
FIG. 7C is an enlarged cross-sectional view of a key portion according to an embodiment where the holding member is a brush type.
Figure 7C:
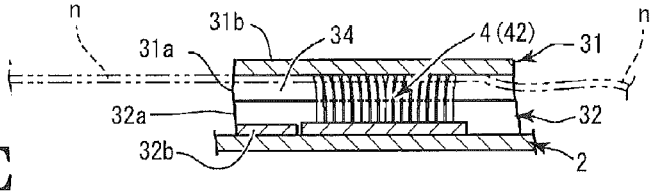

Another embodiment discloses the holding member 4 formed as a brush (see FIG. 7C and FIG. 7D). A brush 42 of the holding member 4 has an approximate tooth brush shape with many brush bristles. The bobbin thread n is pressed securely to the thin edge portion 31*b* of the upper half body 31 by many bristles of the brush 42 (see FIG. 7D). Thereby the bobbin thread can be held and secured while protecting the bobbin thread.

Figure 7E:
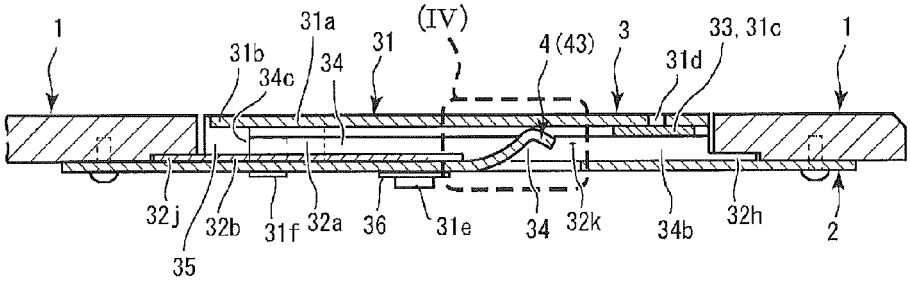
FIG. 7E is an enlarged cross-sectional view of a key portion according to an embodiment where the holding member is a plate spring.
Figure 7E:
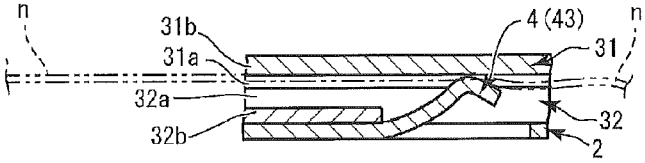

Another embodiment discloses the holding member 4 formed as a spring. In concrete terms, a cutout portion is formed in a part of the base plate 2, and the cutout portion protrudes upward so as to be used as a lever type plate spring 43(see FIG. 7E). Thereby the bobbin thread can be held and secured firmly.

In the above mentioned embodiments, the holding member 4 is secured to or formed in the base plate 2, but an embodiment where the holding member 4 is secured to or formed in the bobbin thread guide member 3 is also possible (see FIG. 7A and FIG. 7B).

This embodiment is particularly suitable for a block 41 made of a felt material, a sponge material or a rubber material. Normally the block 41 is bonded to the rear face of the thin edge portion 31*b* of the upper half body 31 by adhesive, so that the bottom face of the block 41 contacts the base plate 2 with pressing force F.

In the case of the plate spring 43, the tip portion of the plate spring 43 contacts the thin edge portion 31*b* of the upper half body 31 with elastic force, and the bobbin thread n is held and pressed by the tip of the plate spring 43 and the thin edge portion 31*b*, and is secured in this position (see FIG. 7F).

The horizontal rotary hook 5 is constituted by an outer rotary hook 51 and an inner rotary hook 52, and the inner rotary hook 52 is installed inside the outer rotary hook 51. A bobbin 6 is removably attached inside the inner rotary hook 52. A latch portion 51*a* is formed in the outer rotary hook 51. The outer rotary hook 51 hooks a needle thread (not illustrated) while rotating on a horizontal surface, and appropriately interlocks the bobbin thread n drawn out of the bobbin 6 and the needle thread.

Figure 5A:
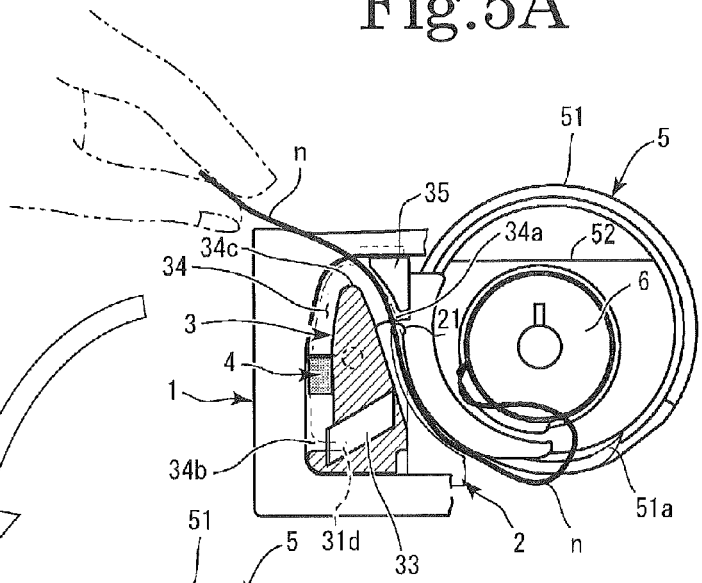
FIG. 5A to FIG. 5C are state diagrams depicting steps of inserting the bobbin thread into the guide groove.
Figure 5B:
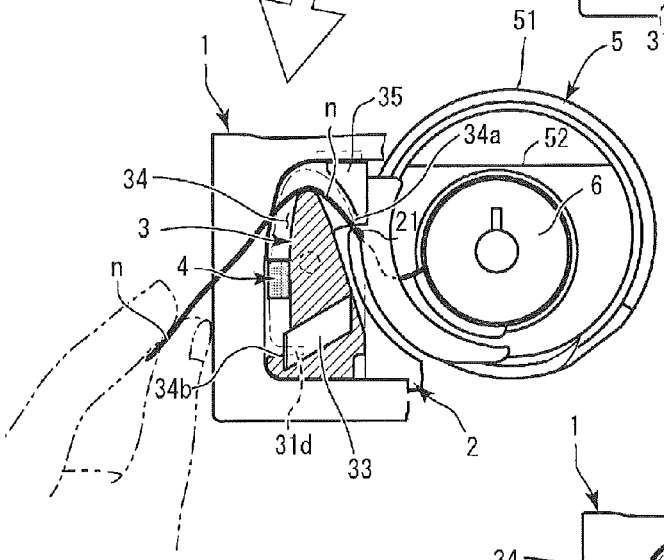
Figure 5C:
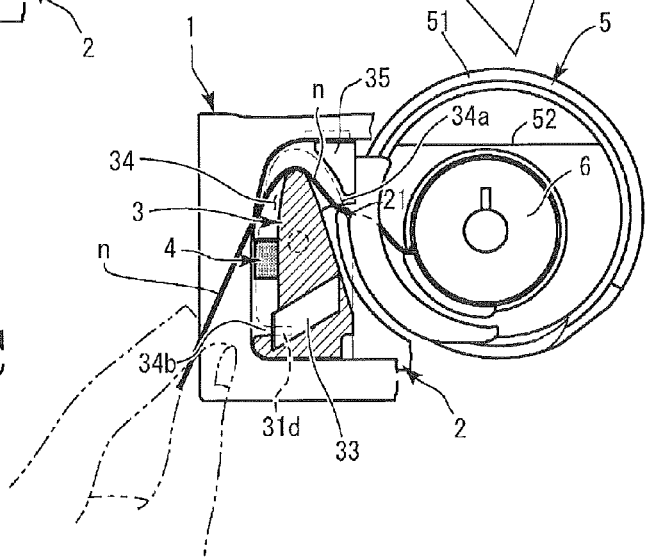

Cutting of the bobbin thread n and maintaining the tense state after the cutting according to the present invention will be described with reference to FIG. 5 and FIG. 6. First the bobbin thread which is wound around the bobbin 6 is drawn out of the housing opening 11. Then the bobbin thread n is inserted into and is passed through the guide slit 21 of the base plate 2, and the bobbin thread n is inserted from the start position 34*a* of the guide groove 34 of the bobbin thread guide member 3 (see FIG. 5A). Then the bobbin thread n is passed through the guide groove 34 so as to be turned back at the turning back portion 34*c*, and is continuously inserted toward the end position 34*b* (see FIG. 5B and FIG. 5C).

At this time, the bobbin thread n is held and secured between the holding member 4 disposed in the guide groove 34 and the thin edge portion 31*b* of the upper half body 31 of the bobbin thread guide member 3 (see FIG. 6A). In other words, the bobbin thread n is inserted between the top portion of the holding member 4 and the thin edge portion 31*b* of the upper half body 31. Then the end of the bobbin thread n is guided into the cutting guide groove portion 31*d* located in the end position 34*b* of the guide groove 34, and the end of the bobbin groove n is cut by the cutting blade 33 protrudes to be exposed outside the cutting guide groove portion 31*d* (see FIG. 6B).

When the bobbin thread n is cut by the cutting blade 33, the bobbin thread n becomes tense by contact with cutting blade 33 (see FIG. 6A and FIG. 6B). The end of the bobbin thread n cut by the cutting blade 33 is held and secured by the holding member 4 in the end position 34*b* of the guide groove 34, hence the bobbin thread n in the guide groove 34 is maintained in the tense state.

Therefore the thread passage of the bobbin thread n with the horizontal rotary hook 5 in the bed under the throat plate 1 is a straight, and the needle thread (not illustrated) is caught by the latch portion 51*a* of the outer rotary hook 51, and appropriately interlocks with the bobbin thread n in the tense state, whereby the bobbin thread n is set in the sewing operation preparation stage.

EXPLANATION OF REFERENCE NUMERALS

1 throat plate
11 housing opening
2 base plate
21 guide slit
3 bobbin thread guide member
33 cutting blade
34 guide groove
4 holding member
5 horizontal rotary hook
6 bobbin
n bobbin thread

What is claimed is:

1. A sewing machine provided with a needle bar to which a needle is attached, a horizontal rotary hook that houses a bobbin on which a bobbin thread for forming stitches in tandem with a vertical operation of the needle bar is wound, a throat plate that houses the horizontal rotary hook in a bed and covers an opening of a top face of the bed, and an opening lid that covers the opening of the throat plate, the sewing machine comprising:

a base plate that has a guide slit for guiding the bobbin thread that is set on a bottom face side of the throat plate; and a bobbin thread guide member that has a guide groove for guiding the bobbin thread supplied from the bobbin and glides a cutting blade provided at an end position of the guide groove to cut the bobbin thread guided along the guide groove to an appropriate length, wherein the bobbin thread guide member is secured to the base plate and has a holding member, which holds an end of the bobbin thread, in the guide groove, so as to maintain a state when the bobbin thread is cut.

2. The sewing machine according to claim 1, wherein the holding member is disposed so as to plug the guide groove.

3. The sewing machine according to claim 1, wherein the holding member comprises an elastic member.

4. The sewing machine according to claim 1, wherein the holding member comprises a felt material.

5. The sewing machine according to claim 1, wherein the holding member comprises a sponge material.

6. The sewing machine according to claim 1, wherein the holding member comprises a rubber material.

7. The sewing machine according to claim 1, wherein the holding member comprises a brush type member.

8. The sewing machine according to claim 1, wherein the holding member comprises a spring.

9. The sewing machine according to claim 1, wherein the bobbin thread guide member is secured to the base plate and has the holding member, which holds the end of the bobbin thread, in the guide groove, so as to maintain a tense state of the bobbin thread when the bobbin thread is cut.

10. The sewing machine according to claim 1, wherein the sewing machine is further provided with a thread needle, and wherein the bobbin thread guide member is secured to the base plate and has the holding member, which holds the end of the bobbin thread, in the guide groove, so as to maintain a state when the bobbin thread is cut such that the bobbin thread and the thread needle interlock.

11. The sewing machine according to claim 1, wherein the holding member is disposed between a start position and the end position of the guide groove, and wherein the holding member is disposed closer to the start position of the guide groove than to a position of the cutting blade.

* * * * *